United States Patent [19]

Schweitzer et al.

[11] 4,357,948

[45] Nov. 9, 1982

[54] SMOKE FILTERING AND COOLING DEVICE

[75] Inventors: Robert A. Schweitzer, 4101 N. 82nd St., Milwaukee, Wis. 53222; James H. Tate, Milwaukee, Wis.

[73] Assignee: Robert Schweitzer, Milwaukee, Wis.

[21] Appl. No.: 215,538

[22] Filed: Dec. 11, 1980

[51] Int. Cl.[3] ..... A24F 1/30

[52] U.S. Cl. ..... 131/173; 138/90

[58] Field of Search ..... 131/173; 285/421, 298, 285/302; 138/89, 90; 55/259

[56] References Cited

U.S. PATENT DOCUMENTS

| | | | |
|---|---|---|---|
| 546,258 | 9/1895 | Suverkrot | 138/90 X |
| 3,920,145 | 11/1975 | McGregor et al. | 138/89 X |
| 4,148,327 | 4/1979 | Graham | 131/173 |
| 4,253,475 | 3/1981 | Schreiber et al. | 131/173 |

*Primary Examiner*—Stephen C. Pellegrino

[57] ABSTRACT

A smoke filtering and cooling device is removably mounted within a cylindrical vertical passage in a tobacco smoking water pipe through which smoke is upwardly directed. The device comprises a selectively expandable/retractable portion which is engageable with the passage wall whereby the device is mechanically supported and a fluid-tight seal is provided so that a quantity of water can be retained in the passage around the device. The device further comprises or defines passageways whereby the smoke is directed through the water for filtering and cooling as it passes through the pipe. A plurality of devices may be arranged one above another in the same water pipe to increase efficiency.

9 Claims, 7 Drawing Figures

SMOKE FILTERING AND COOLING DEVICE

BACKGROUND OF THE INVENTION

1. Field of Use

This invention relates generally to devices or apparatus for filtering and cooling smoke and gases. In particular, it relates to devices which are removably mountable in vertically disposed cylindrical pipes or passages and which retain a quantity of liquid through which upwardly moving smoke or gas passes. The invention is especially well-adapted for use in water cooled tobacco pipes but can be applied to other systems wherein smoke or gas or both needs to be filtered or cooled or both.

2. Description of the Prior Art

Devices employed for filtering and cooling tobacco smoke or the like are well-known and the following patents illustrate the state of the art: U.S. Pat. Nos. 4,148,327; 3,515,146; 3,420,242; 3,416,541; 3,394,710; 2,804,079; 2,209,441; Swiss Pat. No. 35369 (1905); and German Pat. Nos. 9173 (1880) and 3771 (1878).

The aforementioned U.S. Pat. No. 4,148,327 discloses a water pipe for smoking tobacco which takes the form of a double water chamber smoking pipe having a one piece tubular body closed at its lower end and open at its top end with a detachable tobacco bowl mountable through the tubular body and leading to the lower one of said water chambers, a gooseneck tube detachably mounted in said body and communicating with both water chambers and a carb opening in said tubular body. The tobacco is placed in said tobacco bowl and lit and the user initially closes said carb hole and draws on said tubular body open top end drawing smoke through both water chambers. The principle object of the invention is to provide a water pipe having two cooling water chambers and which water pipe can be quickly and easily disassembled for cleaning. The invention requires that the water pipe be of a special shape and have a restricted neck portion. Furthermore, only a single and relatively narrow smoke passageway is provided in the gooseneck filtering device.

SUMMARY OF THE PRESENT INVENTION

In accordance with the invention there is provided an improved device or apparatus for filtering and cooling smoke or gas. The device is removably mountable in a vertically disposed cylindrical passage in a pipe and is adapted to retain a quantity of liquid through which the upwardly moving smoke or gas passes. The device is especially well-adapted for use in water cooled tobacco pipes or the like but can be applied to other systems having a passage wherein smoke or gas needs to be filtered and/or cooled. The device comprises a selectively operable expandable/retractable portion which is engageable with the passage wall whereby the device is mechanically supported in the pipe and a fluid-tight seal with the wall is provided so that a quantity or body of liquid, such as water, can be retained in the passage around the device. The device further comprises or defines a passageway therein whereby the smoke or gas is directed through the water for filtering and cooling as it moves upwardly through the passage. A plurality of devices may be arranged one above another in the same passage to increase efficiency.

In a preferred embodiment the filtering and cooling device for use in a upright passage in a pipe through which smoke or gas rises comprises the following components. A first hollow member having a flexible conical portion at its open bottom end is provided, the first member having both a bolt hole and a gas hole near its upper end. A second hollow member open at its bottom end and closed at its top end is also provided and disposed around and spaced from the first hollow member. The second member has a bolt hole near its upper end in registry with the bolt hole in the first member. The lower portion of the second member extends below the gas hole in the first member. A first base disc is disposed within the flexible conical portion of the first member and has both a bolt hole and a gas hole therethrough. Means, including a bolt extending through all of said bolt holes and having a nut thereon, are provided which when tightened force the base disc into the flexible conical portion of the first member thereby causing the latter to expand peripherally and engage the wall of the passage in sealed relationship.

In operation, gas or smoke in the passage below the device is drawn or forced through the gas hole in the base disc, up through the first hollow member and through the gas hole near the top thereof, into the space between the first and second members and downwardly into the liquid, then around the lower edge of the lower portion of the second member, and finally up through the liquid on the outside of the second member and into the passage above the device.

DRAWINGS

DESCRIPTION OF PREFERRED EMBODIMENTS

Figure 1:
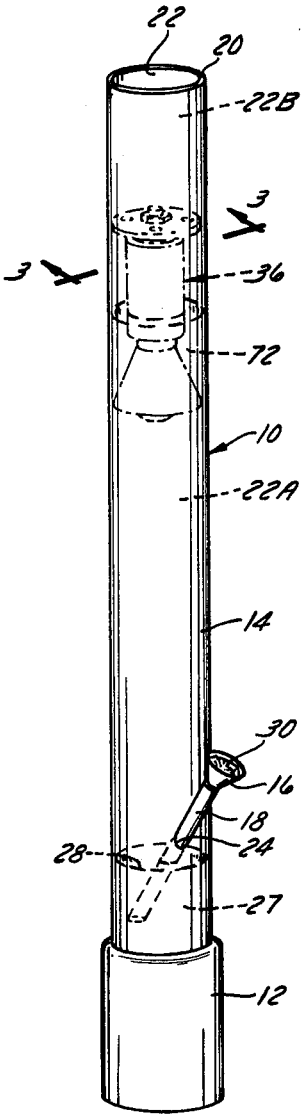
FIG. 1 is an isometric view of a water pipe employing a single smoke filtering and cooling device in accordance with the present invention.

Referring to FIG. 1, the numeral 10 designates a known type of water pipe or bong for smoking tobacco or the like and which comprises a supporting base 12, an upright hollow cylindrical tubular member or tube 14 rigidly mounted on the base 12, and a tobacco bowl 16 having a hollow stem 18 rigidly mounted on tube 14. Tube 14, which may be fabricated of glass or plastic defining a wall 20, includes a cylindrical tube passage 22 there through which is cooled at the bottom end and open at the top end and hollow stem 18 removably extends in sealed relationship through a hole 24 in wall 20 near the bottom end of passage 22. If preferred, the top end of tubular member 14 may be provided with a flexible, detachable annular ring 26, shown in FIGS. 6 and 7, to provide a cushion for the mouth of the person smoking pipe 10.

Figure 7:
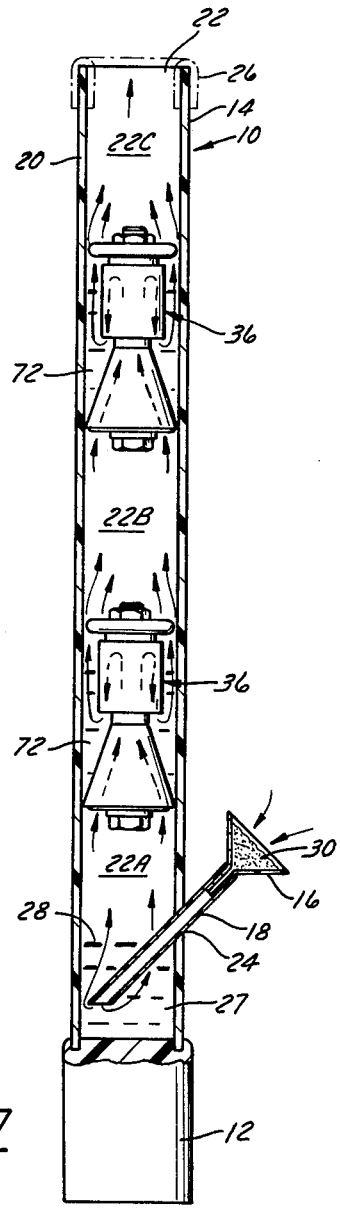
FIG. 7 is a view similar to FIG. 6 but showing the water pipe vertically upright.

In use, as FIG. 1 shows, tube 14 of pipe 10 is filled with a quantity or body of water 27 to a level 28 an bowl 16 is filled with tobacco 30 which, after being ignited, produces smoke which, as FIG. 7 shows, is drawn in the direction of arrows from bowl 16, through stem 18, through the water 27, and upwardly through passage 22 in tube 14 (and through any filtering devices therein) into the mouth of the user.

Passage of smoke through the body of water 27 has the two-fold effect of filtering smoke particulate matter from the smoke and cooling the smoke.

Figure 6:
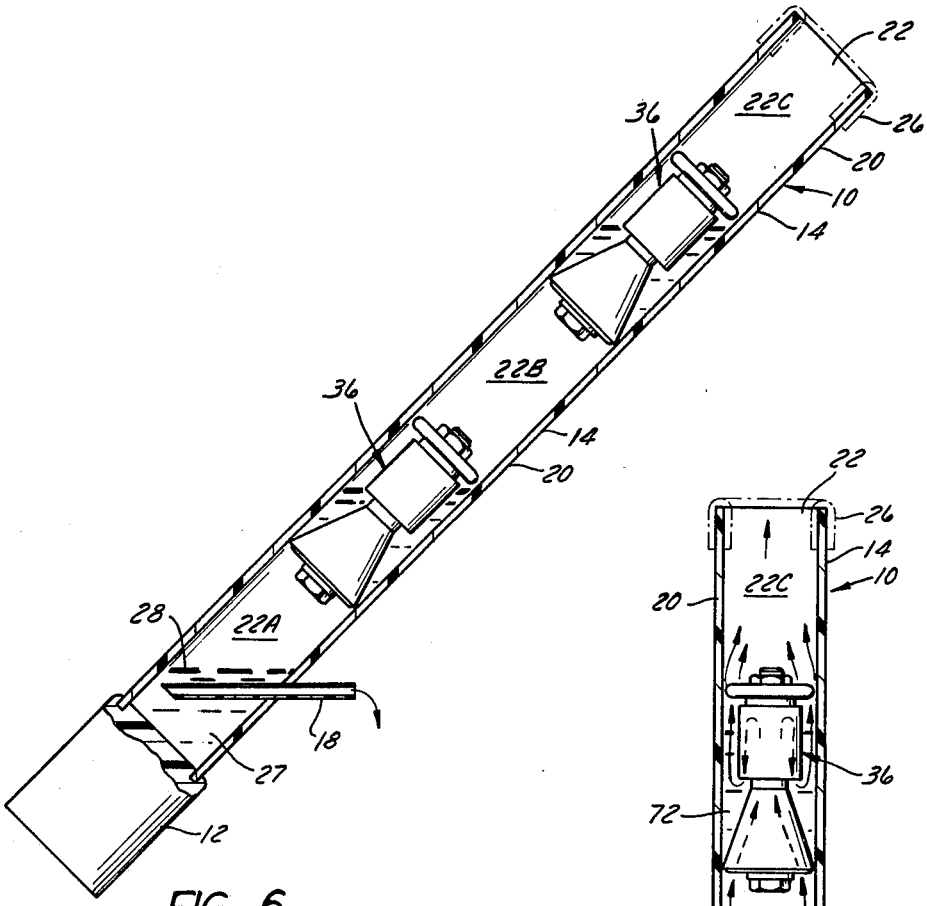
FIG. 6 is a view, with portions broken away, of the water pipe of FIG. 1, shown tilted, and having two smoke filtering and cooling devices therein in accordance with the invention.

FIG. 1 shows that pipe 10 provided with a single smoke filtering and cooling device 36 in accordance with the present invention which operates to provide another stage of filtering and cooling in addition to that provided by the pipe 10 itself. FIGS. 6 and 7 show pipe 10 with two devices 36, one above the other, in a pipe 10 to increase filtering and cooling efficiency.

Figure 4:
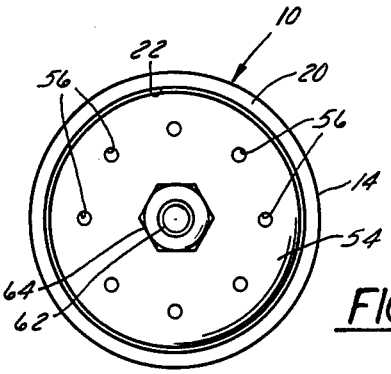
FIG. 4 is a top plan view of the device of FIG. 3.
Figure 3:
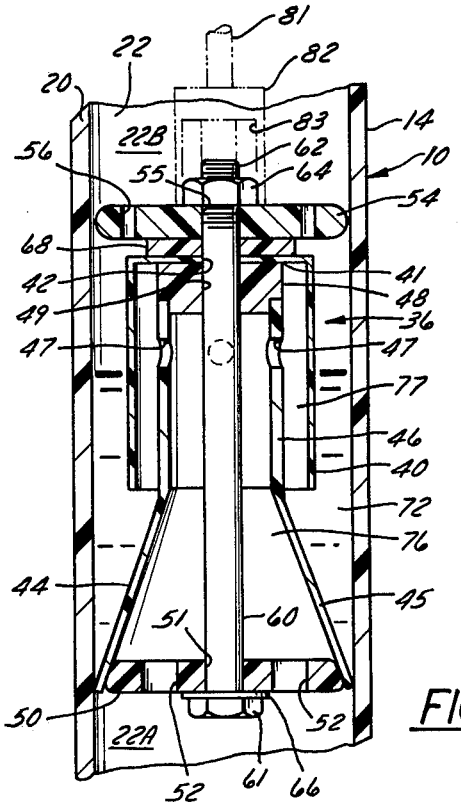
FIG. 3 is an enlarged cross-sectional view of the smoke filtering and cooling device shown in FIG. 1 and also shows a portion of the water pipe.
Figure 5:
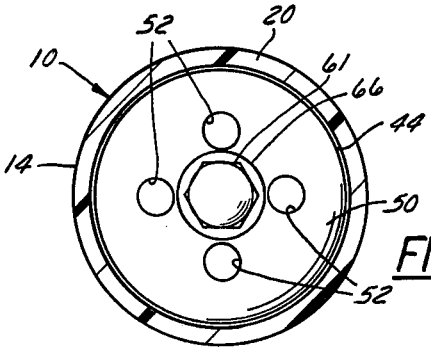
FIG. 5 is a bottom plan view of the device of FIG. 3.

As FIGS. 3, 4 and 5 show, device 36 comprises a hollow cylindrical member or baffle 40 open at its bottom or lower end and closed at its top or upper end by an end wall 41 which has a bolt hole 42 therethrough. Disposed within baffle 40 is a hollow member or funnel module 44 having a downwardly flared conically shaped lower portion 45, an integrally formed hollow cylindrical intermediate portion 46 having a plurality of spaced apart holes 47 arranged around its periphery, and an upper end cap 48 having a bolt hole 49 therethrough secured to the upper end of portion 46 as by gluing. Cap 48 may be integrally formed with portion 46. A lower or base disc 50 of circular shape and having a bolt hole 51, as well as a plurality of smoke passage holes 52 therethrough, is disposed within the lower end of conically shaped portion 45. An upper or splash screen disc 54 of circular shape and having a bolt hole 55, as well as a plurality of smoke and liquid passage holes 56 therethrough, is disposed on top of cap 48. A bolt 60 having a head 61 at its lower end and threads 62 at its upper end for receiving a nut 64 extends upwardly through the afore-mentioned hole 51, 49, 42, and 55. A washer 66 is disposed on bolt 60 between its head 61 and base disc 50. A washer 68 is disposed in bolt 60 between screen disc 54 and baffle 40.

It is to be understood that conically shaped portion 45 of funnel module 44 is formed of relatively thin and flexible material such as plastic and that the outside diameter of the underformed lower most edge 49 of portion 45 is slightly less than the diameter of passage 22 of tube 14 of pipe 10. The diameter of base disc 50 is slightly less than the inside diameter of edge 49 of portion 45. Thus, after device 36 is inserted in pipe 10 and as nut 64 is tightened by means of the tool or wrench 80 shown in FIG. 2, the base disc 50 is forced upward into cone-shaped portion 45 thereby causing edge 47 to expand outwardly and peripherally engage the inner surface of wall 20. Such engagement effects mechanical support of device 36 in tube 14 and also provides a liquid-tight seal entirely around the peripheral edge 49 whereby a body of liquid 72, such as water, can be retained in tube 14 above and spaced from the body of water 27. Device 36 includes or defines a passage-way (designated by the arrows in FIG. 3) through the liquid 72 from that portion 22A of tube passage 22 below device 36 to that portion 22B there above. Such passageway is from portion 22A, through the holes 52, into space 76 within member 44, through the holes 47 into space 77 within member 40, through the body of liquid 72, and upward past the edge of disc 54 and through the holes 56 therethrough into portion 22B of tube passage 22. In FIGS. 6 and 7 the space above the uppermost device 36 is designated 22C.

Figure 2:
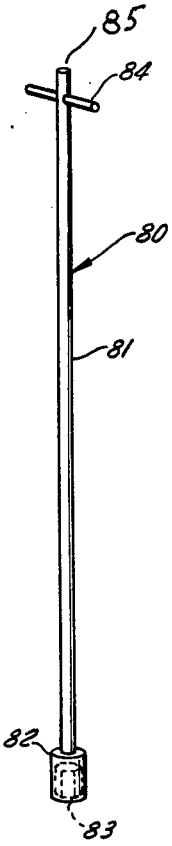
FIG. 2 is an isometric view of an elongated socket wrench tool employed to install and remove the device shown in FIG. 1.

As FIGS. 2 and 3 show, a tool 80 is provided which has an elongated shaft 81 with a socket wrench 82 at its lower end and a threaded hole 85 at its upper end, above a handle 84 which facilitates tool rotation.

Referring to FIGS. 1 and 6, the manner of installing device 36 will now be described. Loosen torque nut 64 at the top of device 36 by means of tool 80 and then insert device 36 in to the top opening of pipe 10, using a tilting motion. Push the device 36 down until the splash screen 54 enters passage 22 and until the top of the splash screen is 5 to 7 inches from the top of pipe 10. If 2 or more devices 36 are used, as shown in FIGS. 6 and 7, they should be spaced evenly apart with the uppermost device 36 no less than 5 to 7 inches from the top of pipe 10. After the device 36 is properly positioned, it is necessary to tighten it by turning torque nut 64 clockwise (with respect to FIG. 4 until the device is snug and then continue turning for $\frac{1}{2}$ to $\frac{3}{4}$ of a turn more. Pour in a little water and check for leaks. If leakage occurs, tap around the base on the outside of the pipe with a tool, such as a plastic screwdriver handle, to insure proper seating. Slowly tighten nut 64 in small increments until the leaking stops but do not overtighten.

Pour water into passage 22 until it reaches the middle of member 40. If two or more devices 36 are being used, fill all levels completely and turn pipe 22 until draw tube or stem 18 is horizontal. This sets all water levels.

Device 36 is removed for cleaning by turning torque nut 64 counterclockwise (with respect-to FIG. 4) until very slack. Thread hole 85 of installation tool 80 onto the threaded end 62 of bolt 60 bolt and gently pull device 36 out of passage 22. Then disassemble device 36 and place its parts in a container full of hot water. Drop in two effervescent denture cleaning tablets, for example, and wait two hours, then rinse parts thoroughly and reinstall.

As the foregoing description makes clear, a device in accordance with the invention offers numerous advantages over the prior art. For example, it can be used in any pipe having a cylindrical passage and does not require a restricted or specially shaped passage. Also, as many devices as needed or desired may be placed in series with each other along the passage. Further, each device can be readily installed and removed even at some distance from the end of a passage by means of the special elongated tool disclosed herein. The device, which is easily disassembled for cleaning and easily reassembled for use, is rugged in construction and able to withstand more abuse in handling than fragile glass prior art devices.

We claim:

1. A filtering and cooling device for use in an upright passage through which smoke or gas rises comprising: first means on said device operable to releasably secure said device in said passage and to effect a seal between said device and the wall of said passage whereby a body of liquid may be retained in said passage in association with said device, said first means comprising an expandable and retractable member engageable with the wall of said passage; and second means on said device and accessible from the exterior of said passage for operating said first means, said second means being selectively operatable to effect expansion or contraction of said member; said device including passageway means for directing said smoke or gas through said body of liquid.

2. A device according to claim 1 wherein said passageway extends through said member.

3. A device according to claim 2 wherein said member takes the form of hollow flexible cone open at its bottom end and wherein said second means comprises a movable member axially movable relative to said cone in the lower end thereof to effect sealing engagement of said lower end of said cone with the wall of the passage in which the device is disposed.

4. A device according to claim 3 wherein said second means includes means for effecting relative axial movement between said cone and said movable member.

5. A device according to claim 4 wherein said last-recited means includes threaded members.

6. A filtering and cooling device for use in an upright passage through which smoke or gas rises to retain a body of fluid in the passage and provide a passageway through the fluid comprising: a first hollow member having a flexible conical portion at its bottom end and being open at its bottom end, said first member having both a bolt hole and a gas hole near its upper end; a second hollow member open at its bottom end and closed at its top end and disposed around and spaced from said first hollow member, said second having a bolt hole near its upper end in registry with said bolt hole in said first member, the lower portion of said second member extending below said gas hole in said first member; a first base disc disposed within said flexible conical portion of said first member and having both a bolt hole and a gas hole therethrough; and means including a bolt extending through all of said bolt holes, said bolt having a nut thereon which when tightened forces said base disc into said flexible conical portion thereby causing the latter to expand peripherally and engage the wall of said passage.

7. A device according to claim 6 including a second disc of smaller diameter than said passage disposed on said screw above said second member and having both a bolt hole and another hole therethrough.

8. In combination:

a water pipe comprising a tube having a uprightly disposable passage closed at its lower end and open at its upper end and having a smoke admitting opening near its lower end, said passage being adapted to retain a first body of liquid at its bottom end, the surface of which first body is above said opening when said passage is uprightly disposed; and a smoke filtering and cooling device removably mounted in said passage above and spaced from said first body of liquid, said device being adapted to retain another body of liquid associated therewith and to provide a passageway for smoke through said other body of liquid, said device including selectively operable expandable and retractable adjustment means accessible from the exterior of said passage in said tube for releasably securing said device in said tube.

9. A combination according to claim 8 including a plurality of said devices disposed one above another in said passage.

* * * * *